US008347945B1

(12) United States Patent
Taffet et al.

(10) Patent No.: US 8,347,945 B1
(45) Date of Patent: Jan. 8, 2013

(54) PLATFORM INTERCONNECTED WITH MID-BODY CORE INTERFACE FOR MOLDING AIRFOIL PLATFORMS

(75) Inventors: Steven Taffet, South Windsor, CT (US); Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/193,956

(22) Filed: Jul. 29, 2011

(51) Int. Cl.
*B22C 9/10* (2006.01)

(52) U.S. Cl. ..... 164/137; 164/369

(58) Field of Classification Search ..... 164/137, 164/340, 369, 370
See application file for complete search history.

(56) References Cited

U.S. PATENT DOCUMENTS

| | | | |
|---|---|---|---|
| 7,056,093 | B2 | 6/2006 | Self et al. |
| 7,458,411 | B2 | 12/2008 | Prigent et al. |
| 2009/0095435 | A1 | 4/2009 | Luczak et al. |
| 2011/0020115 | A1 | 1/2011 | Hudson |

*Primary Examiner* — Kuang Lin
(74) *Attorney, Agent, or Firm* — Carlson, Gaskey & Olds, PC

(57) ABSTRACT

A method of molding a platform opening includes the steps of providing a main body core and a platform core, with the main body core having a portion that forms a portion of the platform. The platform core has at least one side portion that will form a side opening. Molten metal is directed around the cores within a mold and solidifies. The cores are removed, leaving cavities where the cores were within the molten metal, and includes an opening in a side face formed by the side portion of the platform body core. Lost core components are also disclosed and claimed.

20 Claims, 5 Drawing Sheets

PLATFORM INTERCONNECTED WITH MID-BODY CORE INTERFACE FOR MOLDING AIRFOIL PLATFORMS

STATEMENT REGARDING FEDERALLY SPONSORED RESEARCH OR DEVELOPMENT

This invention was made with government support under Contract No. N00019-06-C-0294 awarded by the United States Navy. The Government has certain rights in this invention.

BACKGROUND

This application relates to a method of molding a platform for an airfoil, wherein lost core elements are utilized.

Airfoils are known and are utilized in a number of applications. In one common application, airfoils are utilized in turbine and compressor sections for gas turbine engines. The airfoils have a platform which may be mounted to a rotor structure. In particular, static vanes associated with the turbine or compressor sections include airfoils and platforms.

The airfoils can be exposed to high temperatures, and thus it is known to circulate cooling air within passages inside the airfoils and platforms. Thus, the combined airfoil and platform must have openings to receive the cooling air, and to communicate the cooling air into internal passages.

To form passages in airfoils and their platforms, so-called "lost core" molding techniques have been utilized. In a lost core molding technique, an element is made of a material which can be leached or otherwise dissolved, and which bears the shape of desired openings and spaces in the airfoil and platform.

In the prior art, there has been a main body core, which has been placed in a mold, and then utilized as a lost core component to form openings in a final platform. Molten metal is moved into the mold, and solidifies around the cores. Then the cores are dissolved or leached, leaving cavities within the final part.

Typically, a large opening is formed at a top of the platform to receive cooling air delivered toward the airfoil. From this large opening, side openings extend into cooling chambers within the platform.

Typically, a portion of one of the cores has extended upwardly beyond the top surface of the platform to form an opening in the top surface once the core has been leached away. This opening then provides an access point such that a machine, such as an electro-discharge machine (EDM) is able to move in, and machine the rest of the large opening away.

At that point, the side openings must be formed such as by cutting into an intermediate part.

SUMMARY

A method of molding a platform opening includes the steps of providing a main body core and a platform core, with the main body core having a portion that forms a portion of the platform. The platform core has at least one side portion that will form a side opening. Molten metal is directed around the cores within a mold and solidifies. The cores are removed, leaving cavities where the cores were within the molten metal, and includes an opening in a side face formed by the side portion of the platform body core.

Lost core components are also disclosed and claimed.

These and other features of the present invention can be best understood from the following specification and drawings, of which the following is a brief description.

DETAILED DESCRIPTION

Figure 1A:
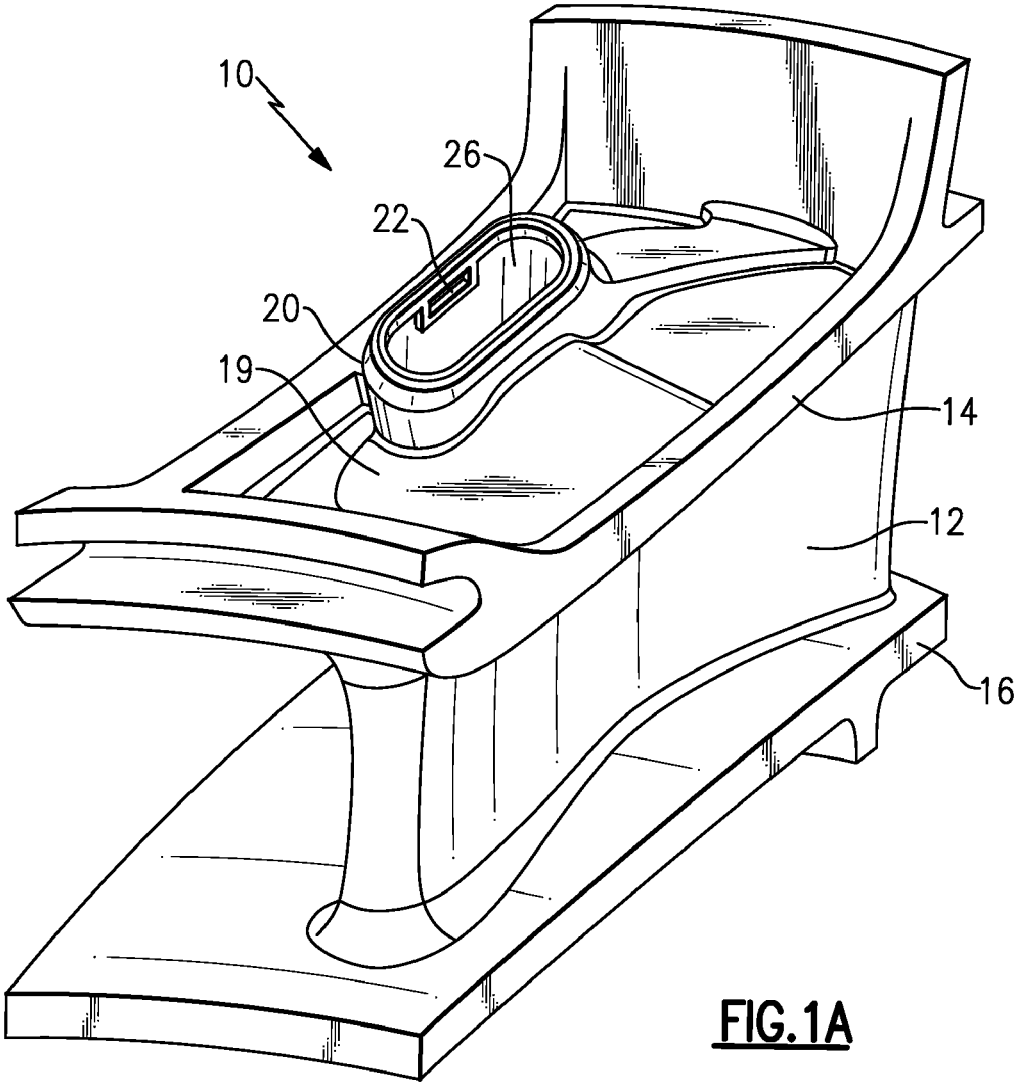
FIG. 1A shows a vane for use in a gas turbine engine.

A vane 10 is illustrated in FIG. 1A, and would typically be utilized in a turbine section of a gas turbine engine. While this application specifically discloses a method for forming a portion of a vane, other components, such as turbine blades, may benefit from the teachings of this application.

As shown, an airfoil 12 extends between an inner platform 14 and an outer platform 16. It is known in the art that the airfoil 12, and platforms 14 and 16 include any number of flow passages for circulating cooling air. Thus, as shown in FIG. 1A, an opening 26, and a side opening 22 are formed to bring cooling air through the platform 14, and to the airfoil 12, and platform 16. As shown, a boss 20 forms the opening 26, and extends inwardly from a nominal face 19 of the platform 14.

For purposes of this application, the boss 20 and the nominal end face 19, together form outer inner end face of the platform 14.

Figure 1B:
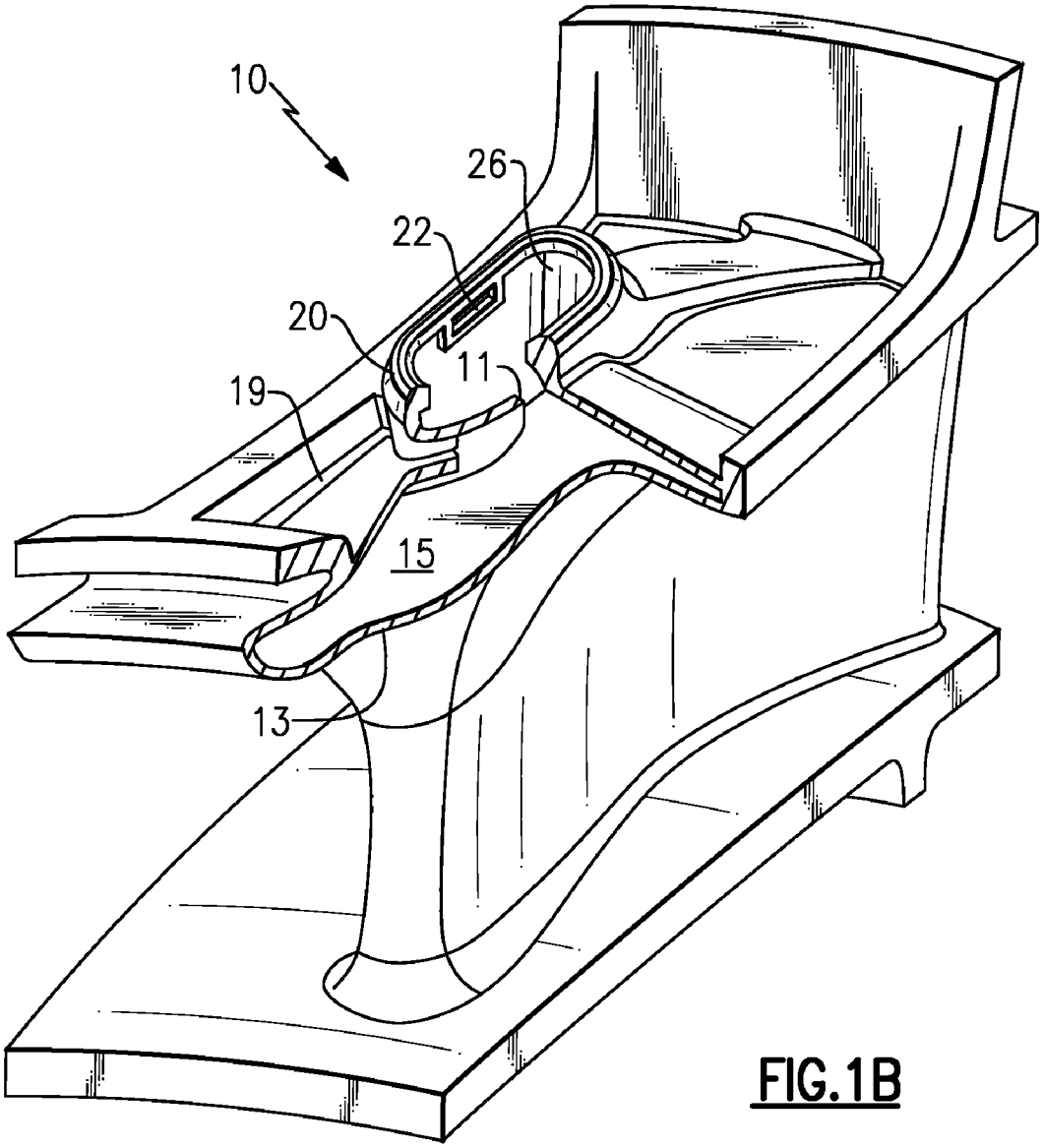
FIG. 1B shows another detail of the vane.

FIG. 1B shows the vane 10 having a portion of the nominal face 19 cut away, and a portion of the boss 20 cut away. One can see there is a lower wall 13 on an opposed side of the nominal face 19, and a cooling chamber 15 is defined between the two faces 19 and 13. A side opening 11 is formed within the boss 20, and delivers air into the cooling chamber 15. Side opening 22 also delivers air into chamber 15.

Figure 1C:
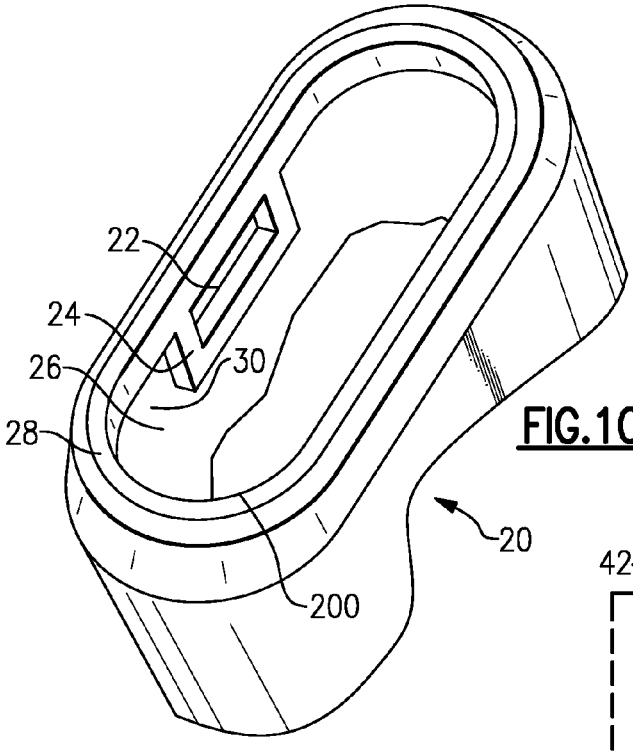
FIG. 1C shows a portion of a final platform.

FIG. 1C shows a boss 20 having an opening 26 surrounded by a lip 28. As show, a platform side opening 22 extends through a side wall 30 of the boss, and allows cooling air flow in to the platform, and also within the interior of the airfoil.

As can be appreciated, the enlarged opening 26 provides a relatively large cross-section for air flow. Also, as can be seen, the opening 22 has a frame 24, which extends inwardly from the nominal inner wall 30 of the boss 20. The lip 28 also extends inwardly of inner wall 30.

Figure 2:
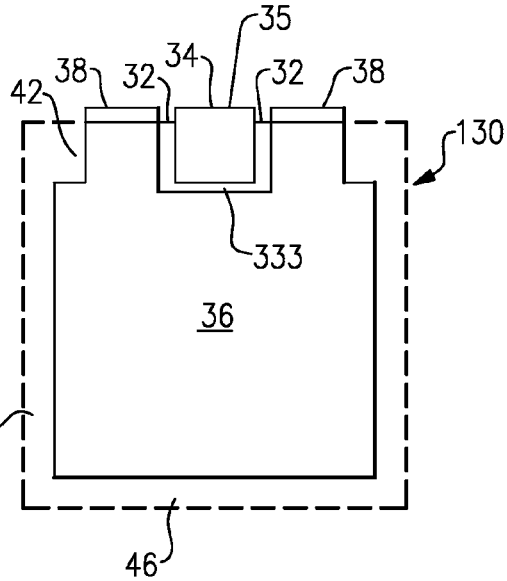
FIG. 2 schematically shows a molding operation.

FIG. 2 schematically shows a molding system 130 for forming the boss 20. As can be appreciated, FIGS. 2-6 focus on the molding of only the boss 20, openings 11, 22 and 26, and their associated structure. In fact, the entire molding system 130 would include a good deal of other cores and components to form the entire vane 10. As shown, a first lost core element 36 is combined with a second lost core element 34. The lost core element 36 is placed within the mold 130, and there is space 42, 44, and 46 about this core 36. As is known, when molten metal is injected into the mold 130, the spaces 42, 44, and 46 will form the boss as shown in FIG. 1A. As can be appreciated, portions 38 and 35 extend outwardly beyond the end of the mold. Thus, those core portions will be found in an intermediate molded part, and will ensure that cavities extend outwardly to the end of the intermediate part, as will be explained below.

The core portion 34 is spaced at 32 from the portions 38. The molten metal will move into the spaces 32 such that the walls 132 (see FIGS. 4A and 5A) will also be formed in the intermediate part. Also, as shown, a space 333 between portions 34 and 36 also receives metal.

Figure 3A:
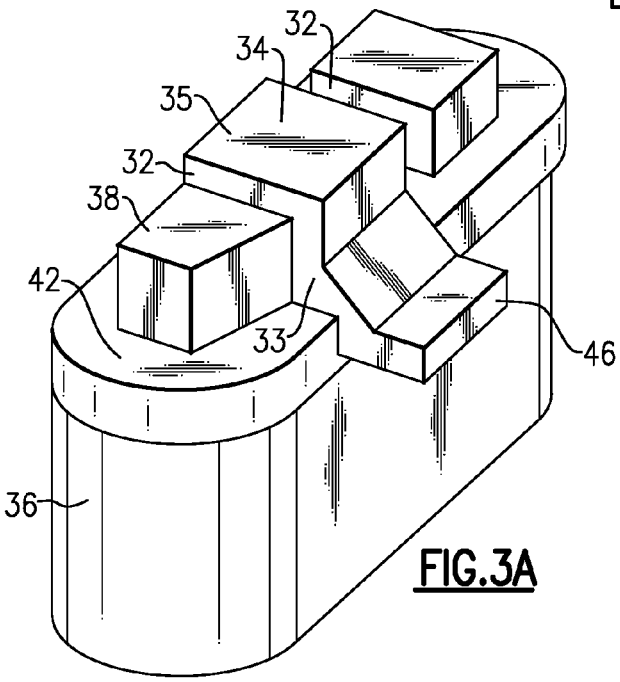
FIG. 3A shows the initial lost core structures assembled together.

FIG. 3A shows further detail of the cores 34 and 36. As shown, the core 36 extends to the upper portions 38 upwardly beyond shoulders 42. The core portion 34 has an element or side portion 46 extending outwardly, and which will form the opening 11 in the final molded part.

As shown, edges 33 of the mold core 34 are spaced from the portions 38 such that there are spaces 32 when the two cores are assembled together. Some way of positioning the two relative to each other within the mold is preferably utilized.

Figure 3B:
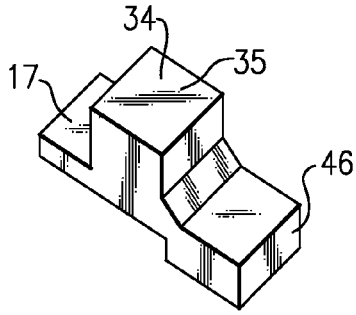
FIG. 3B shows one of the two lost core structures.

As shown in FIG. 3B, the core 34 has another portion 17 which extends from an opposed side of the top portion 35, and forms the opening 22.

Figure 4A:
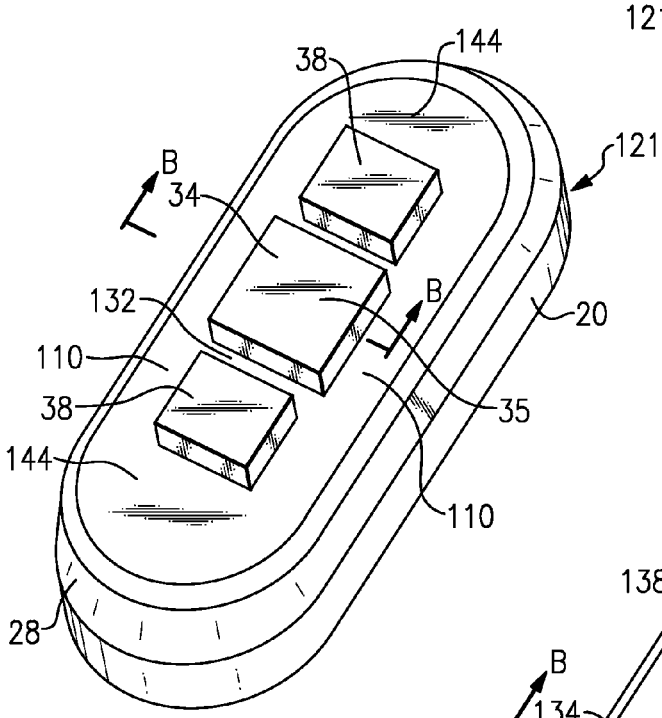
FIG. 4A shows the initial molded structure.

FIG. 4A shows a first intermediate product 121 which would come out of the mold 130 after the molding process of FIG. 2. As can be seen, walls 132 are formed between the uppermost portion 35 of the core 34, and the uppermost portions 38 of core 36. The product will have solid portions 144 beyond each of the extreme ends of the portions 38. Similarly, there are portions 110 along each side of the portions 35 and 38.

Figure 4B:
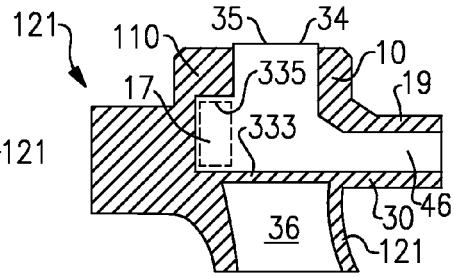
FIG. 4B shows a further detail of the FIG. 4A intermediate part.

FIG. 4B shows a detail of the formation of the side walls in the intermediate part 121. As shown, the portion 17 extends through the side wall of the boss, and will eventually form the opening 22. On the other side, the portion 46 extends through a side wall of the boss, and will form the opening 11. It should be understood that 17 and 46 can be extended to form the platform cooling chamber 15 which is to the bottom of the face 19 and the top of a face 30 in FIG. 4B. However, those extensions have been omitted for simplicity in this Figure. Also, FIG. 4B (and 5B) are somewhat simplified in that portions 17 and 46 are illustrated on the same vertical plane. As can be appreciated from FIG. 3B, the portion 46 is actually beneath portion 17.

The provision of the portions on the platform core which form the side openings eliminates the need for machining of the side openings after the initial molding. As such, the provision of the combined cores greatly simplifies the manufacture of the final product.

Figure 5A:
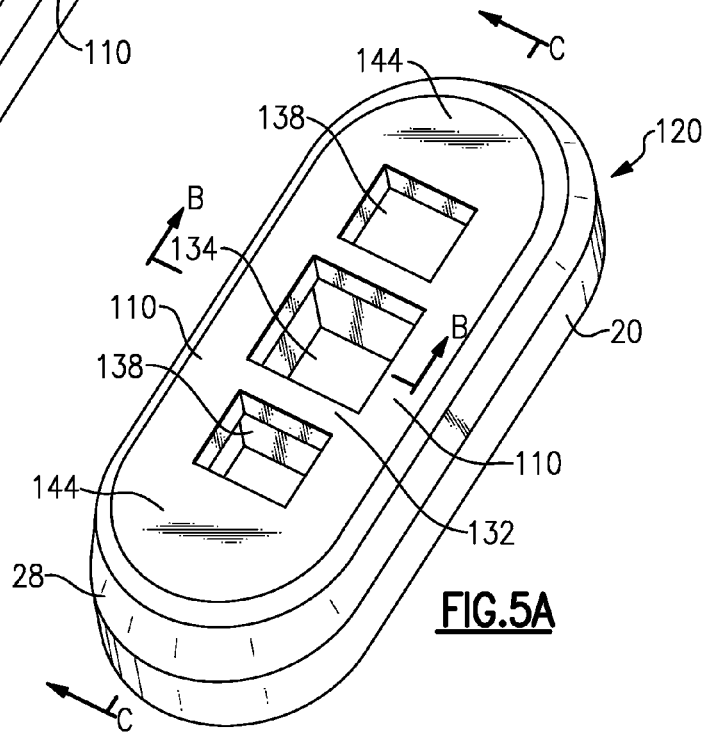
FIG. 5A shows the FIG. 4 structure after the cores have been dissolved away.
Figure 5B:
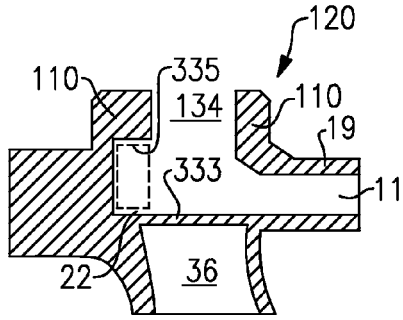
FIG. 5B shows another detail of the FIG. 5A intermediate part.

FIG. 5A shows a second intermediate part 120 after the core portions have been removed. A worker of ordinary skill in the art would know that the cores are formed of some material which can be dissolved, leached, etc., leaving cavities 134 and 138 as shown in FIGS. 5A and 5B. After the procedure as shown in FIG. 5A, the intermediate part end face would include the material 144, the material 110, and the walls 132.

FIG. 5B shows the FIG. 4B after the core 34 has leached away. As shown, the openings 22, 11, and 134 remain. As shown, opening 22 communicates with a portion of the cooling chamber 15 extending into and out of the plane of the Figure (and also in FIG. 4B).

Also seen in FIGS. 4A and 5A, is boss 20.

Figure 6:
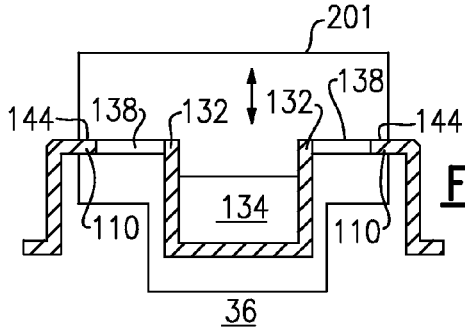
FIG. 6 schematically shows electro-discharge machining to the FIG. 5 product.

As shown schematically in FIG. 6, intermediate part 120 will receive electro-discharge machining such as by tool 201 (shown schematically) to remove the material 144, walls 132, and material 110. What remains is the boss 20 of FIGS. 1A, 1B and 1C, having an opening 26 with a lip 200 extending inwardly from the inner wall 30, and the frame 24 (FIGS. 5A and 5B) around the opening 22. Alternatively, a milling process may be used.

By providing the open spaces 134 and 138 as shown in FIG. 5A, the surface area required for electro-discharge machining to get to the structure of FIGS. 1A, 1B and 1C is dramatically reduced.

Figure 7A:
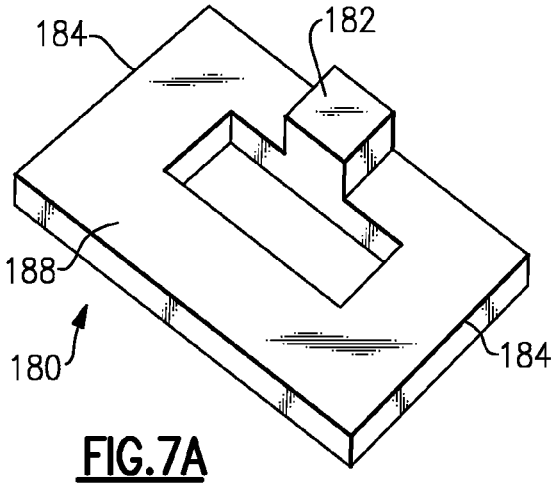
FIG. 7A shows an alternative platform mold.
Figure 7B:
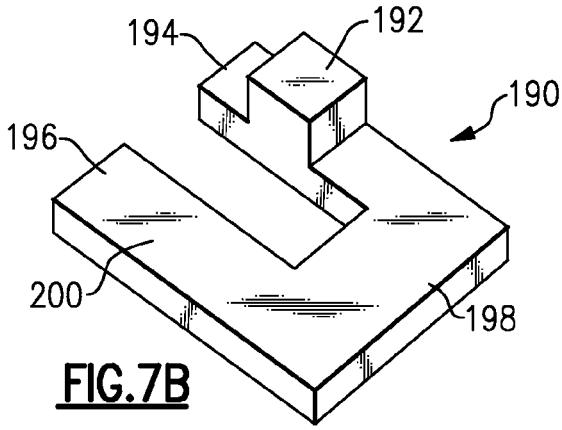
FIG. 7B shows yet another alternative platform core.
Figure 7C:
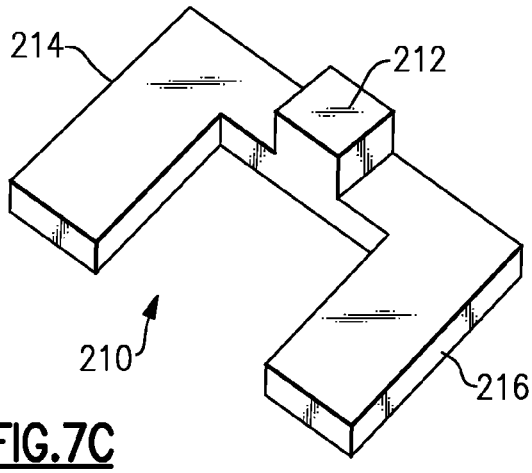
FIG. 7C shows yet another alternative platform core.

Alternative platform cores are illustrated in FIGS. 7A-7C. This shows the power of forming the side openings of any shape and location that is provided by the use of the platform cores.

As shown in FIG. 7A, a core 180 has the upper surface 182, and side extensions 184 which will form the side openings in the final product. A portion 188 would be positioned on the opposed side of the portion 38 of the main body core.

FIG. 7B shows an alternative 190, wherein two portions 194 and 198 will form side openings. A portion 200 can be positioned on the opposed side of the portion 38 of the body core.

FIG. 7C shows a core 210 having a portion 212, and portions 214 and 216 that will form side openings.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of molding a platform comprising the steps of:

a) placing a main body core, and a platform core in a mold, said main body core having a portion which will form a part of the platform, and the platform core having at least one side portion which will form a side opening in an intermediate molded part at a side face;

b) directing molten metal around the cores within a mold, and allowing the molten metal to solidify, with said side portion of said platform core extending at least through said side face within the intermediate molded part; and c) removing the main body core and the platform core, leaving a cavity within the metal, and including the side opening in the side face formed by the side portion of the platform core.

2. The method as set forth in claim 1, wherein said part of the platform is a boss extending away from a nominal portion of an end face of the platform, and the boss defining the side face.

3. The method as set forth in claim 2, wherein there are two side portions on said platform core which form two side openings in side faces of the boss.

4. The method as set forth in claim 2, wherein said side opening connects an inner portion of said boss to a platform cooling chamber.

5. The method as set forth in claim 4, wherein said platform cooling chamber is formed between said end face of the platform, and another face spaced from said end face.

6. The method as set forth in claim 5, wherein there are two of said side portions on the platform core, and forming two of said side openings in said side face of said boss, with each of said side openings communicating an inner portion of said boss to the platform cooling chamber.

7. The method as set forth in claim 1, wherein there is at least one end opening portion formed in said main body core, and leaving at least one end opening when the main body core is removed.

8. The method as set forth in claim 7, wherein the platform core also has an end opening portion extending at least to the end face, and also leaving an opening after being removed in step c), with an intermediate wall formed between the end opening formed by the said platform core, and the end opening formed by said main body core.

9. The method as set forth in claim 7, wherein there are portions of said end face that remain beyond said end opening formed by said end opening portion of said main body core, and along opposed faces of said end opening, such that said end face includes material on all four sides of said opening formed by said main body core.

10. The method as set forth in claim 7, wherein an electrodischarge machining operation removes material around said one end opening to form a large opening in said boss in an intermediate part formed in the mold.

11. The method as set forth in claim 7, wherein a milling process removes material around said one end opening to form a large opening in said boss in an intermediate part formed in the mold.

12. The method as set forth in claim 1, wherein said side opening has a frame formed by said platform core.

13. The method as set forth in claim 1, wherein said platform is part of a gas turbine engine vane.

14. The method as set forth in claim 1, wherein said main body core and said platform core are formed as separate parts.

15. The method as set forth in claim 5, wherein said platform core forming said platform cooling chamber, along with said side opening.

16. A core arrangement for being utilized in lost core molding comprising:

a main body core having a portion for forming a part of the platform, said main body core having at least one top portion extending in a direction which will be at an end face of the platform formed in a molded part molded around said main body core;

a platform core also having a top portion which will be at the end face of the platform, and said platform core being positioned to have its top portion spaced from said top portion of said main body core such that when utilized in a mold, there will be walls formed between said top portion of said platform core and said top portion of said main body core; and said platform core having a side portion to form a side opening in the molded part.

17. The core arrangement as set forth in claim 16, wherein said platform core having at least two side portions for forming at least two side openings.

18. The core arrangement as set forth in claim 16, wherein said main body core having two spaced upper portions, with said platform core received there between.

19. The core arrangement as set forth in claim 16, wherein said platform core extending across a width of said main body core, with said side portions extending beyond sides of said main body core.

20. The core arrangement as set forth in claim 16, wherein said main body core and said platform core are formed as separate parts.

* * * * *